United States Patent [19]

Billmeyer et al.

[11] 4,153,036

[45] May 8, 1979

[54] FIREPLACE CONSTRUCTION

[75] Inventors: Thomas F. Billmeyer; Francis L. Faehling, both of Wisconsin Rapids, Wis.

[73] Assignee: Preway Inc., Wisconsin Rapids, Wis.

[21] Appl. No.: 853,561

[22] Filed: Nov. 21, 1977

Related U.S. Application Data

[60] Continuation of Ser. No. 703,684, Jul. 8, 1976, abandoned, which is a division of Ser. No. 604,613, Aug. 14, 1975, Pat. No. 4,095,581.

[51] Int. Cl.[2] ..... F24B 7/00

[52] U.S. Cl. ..... 126/121

[58] Field of Search ..... 126/121, 122; 237/51

[56] References Cited

U.S. PATENT DOCUMENTS

| | | | |
|---|---|---|---|
| 342,776 | 6/1886 | Bennett | 126/121 |
| 1,539,591 | 5/1925 | Ovington | 126/121 |
| 2,243,751 | 5/1941 | Donley | 126/121 |
| 2,863,443 | 12/1958 | Hoffman | 126/121 |
| 3,368,545 | 2/1968 | Ibbitson | 126/121 |
| 3,845,754 | 11/1974 | Wilkening | 126/121 |
| 3,976,048 | 8/1976 | Ashman | 126/202 |

FOREIGN PATENT DOCUMENTS

| | | | |
|---|---|---|---|
| 785800 | 11/1957 | United Kingdom | 126/121 |

*Primary Examiner*—Carroll B. Dority, Jr.

*Attorney, Agent, or Firm*—Wegner, Stellman, McCord, Wiles & Wood

[57] ABSTRACT

A prebuilt fireplace construction for installation in a building structure, such as a mobile home. The construction includes a firebox having an open side and a combustion gas outlet adapted to be placed in fluid communication with a flue. A transparent door is provided for substantially sealing the open side and a housing at least partially surrounds the firebox in close proximity thereto to define an air space therebetween. The air space has a relatively low inlet and a relatively high outlet. A conduit isolated from the air space is provided and is adapted to be placed in fluid communication with a source of outside air. The conduit opens into the firebox to provide combustion air. A baffle is interposed between the opening of the conduit into th firebox and the combustion area thereof.

2 Claims, 4 Drawing Figures

3
46
20
42
54
54
90
94
58
92
94
94
100
3.

74
70
72
56
74
76
72
58
92
94
94
104
96
96
94
104
104
96
100
104
96
102

FIREPLACE CONSTRUCTION

CROSS-REFERENCE TO RELATED APPLICATIONS

This application is a continuation of application Ser. No. 703,684, filed July 8, 1976 and now abandoned, with said prior application being a division of application Ser. No. 604,613, filed Aug. 14, 1975 and now U.S. Pat. No. 4,095,581.

BACKGROUND OF THE INVENTION

This invention relates to fireplace constructions, and, more specifically, to prebuilt constructions adapted to be located in structures such as mobile homes or the like.

The use of preconstructed fireplace constructions is on the increase because of the ease of installation of such constructions in a building structure. This is particularly true in the case of mobile homes where, because of the ever present possibility that the home will be moved, it is undesirable to resort to relatively permanent, masonry construction employed in conventional fireplaces.

In such preconstructed fireplaces, since masonry is not employed to any great extent, it is desirable to provide an air space surrounding the firebox for insulation purposes and for providing a source of heat through convection currents to the structure in which the fireplace construction is housed.

It is also desirable in certain structures, such as in mobile homes, that fireplaces employed therein be provided with a source of outside air to preclude the possibility of oxygen starvation within the structure due to the combustion reaction itself.

SUMMARY OF THE INVENTION

It is the principal object of the invention to provide a new and improved preconstructed fireplace construction. More specifically, it is an object of the invention to provide such a structure suitable for use in mobile homes or the like.

According to one aspect of the invention in the broadest sense, the foregoing objects are achieved in a construction including a firebox having an open side and a combustion gas outlet adapted to be in fluid communication with a flue. A transparent door is provided for substantially sealing the open side to preclude products of combustion from exiting into the structure in which the fireplace construction is housed. A housing at least partially surrounds the firebox in close proximity thereto to provide an air space between the firebox and the housing. An inlet is located in the housing through which air in the structure housing the fireplace may enter the housing. An outlet is provided through which air in the housing can exit to re-enter the structure. The housing inlet and outlet define a first air flow path. Means are provided for introducing air from a point exterior of the structure to the interior of the firebox, thereby establishing a second air flow path from the first air flow path to provide a source of combustion air and for eliminating the possibility that products of combustion may enter the first air flow path to be discharged into the structure housing the fireplace.

According to another aspect of the invention in its broadest sense, the foregoing objects are achieved in a fireplace construction having a housing and a firebox as mentioned previously. A conduit in fluid communication with an opening in the firebox is adapted to be connected to a source of air exteriorly of the structure and the conduit extends exteriorly of the housing. A fixed baffle within the firebox is disposed across the opening of the conduit into the housing to diffuse combustion air to thereby enhance combustion and preclude the possibility of sparks, cinders, or the like from entering the exterior air conduit.

Other features of the invention employable with structures made according to either aspect of the invention as aforesaid, include the locating of the opening of the conduit for the exterior air in the firebox adjacent the lower extremity of the firebox.

In an embodiment of the invention, the opening of the conduit for the external air may be located below the door and a hearth structure employed to overlie and house the conduit for the exterior air.

Other objects and advantages will become apparent from the following specification taken in connection with the accompanying drawings.

DESCRIPTION OF THE PREFERRED EMBODIMENT

Figure 1:
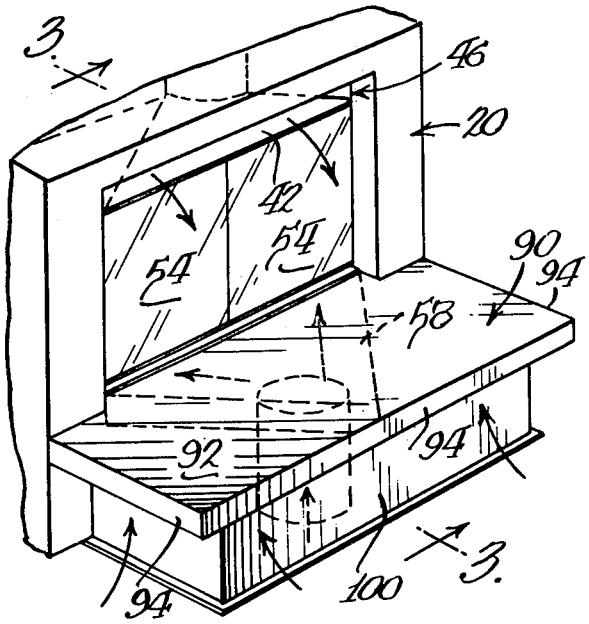
FIG. 1 is a fragmentary, perspective view of an embodiment of a fireplace construction made according to the invention.
Figure 2:
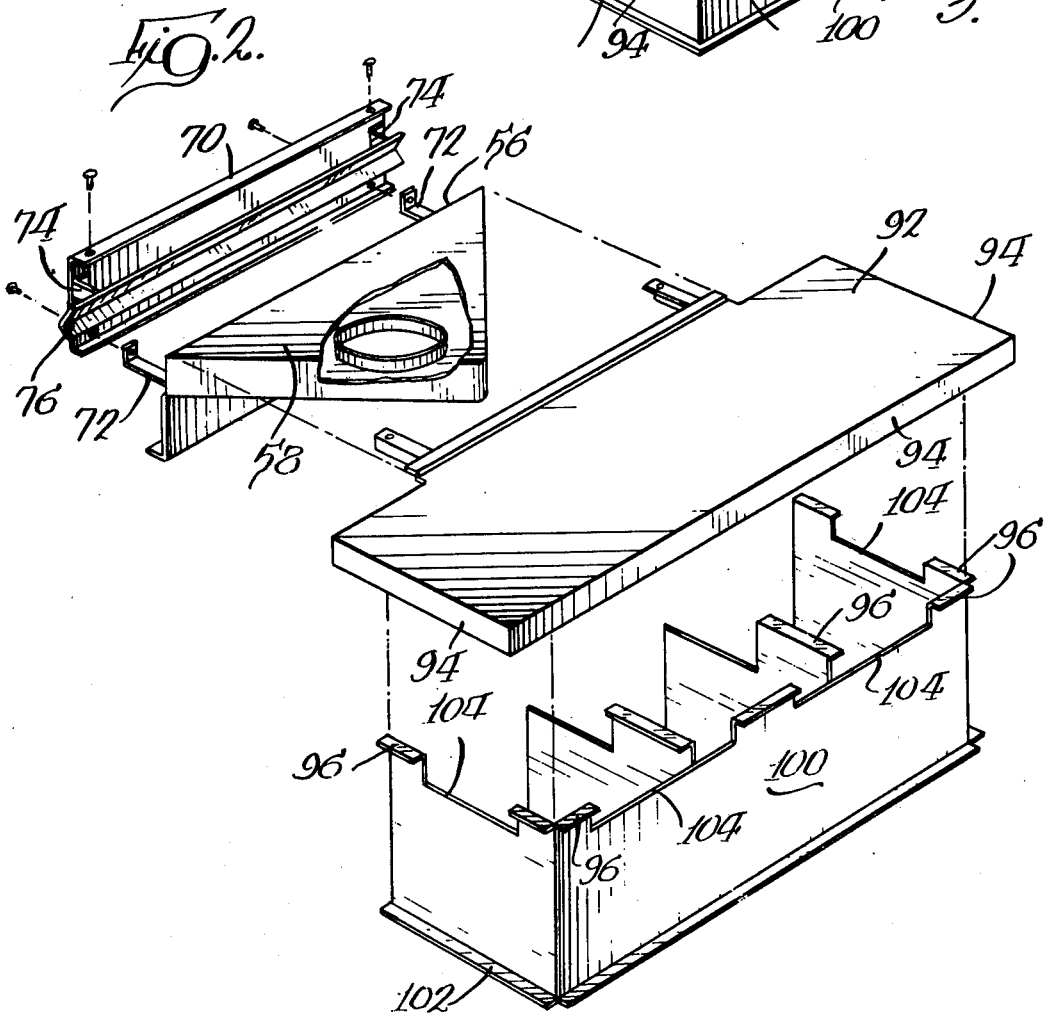
FIG. 2 is an exploded, perspective view of a hearth structure employed in the embodiment illustrated in FIG. 1.
Figure 3:
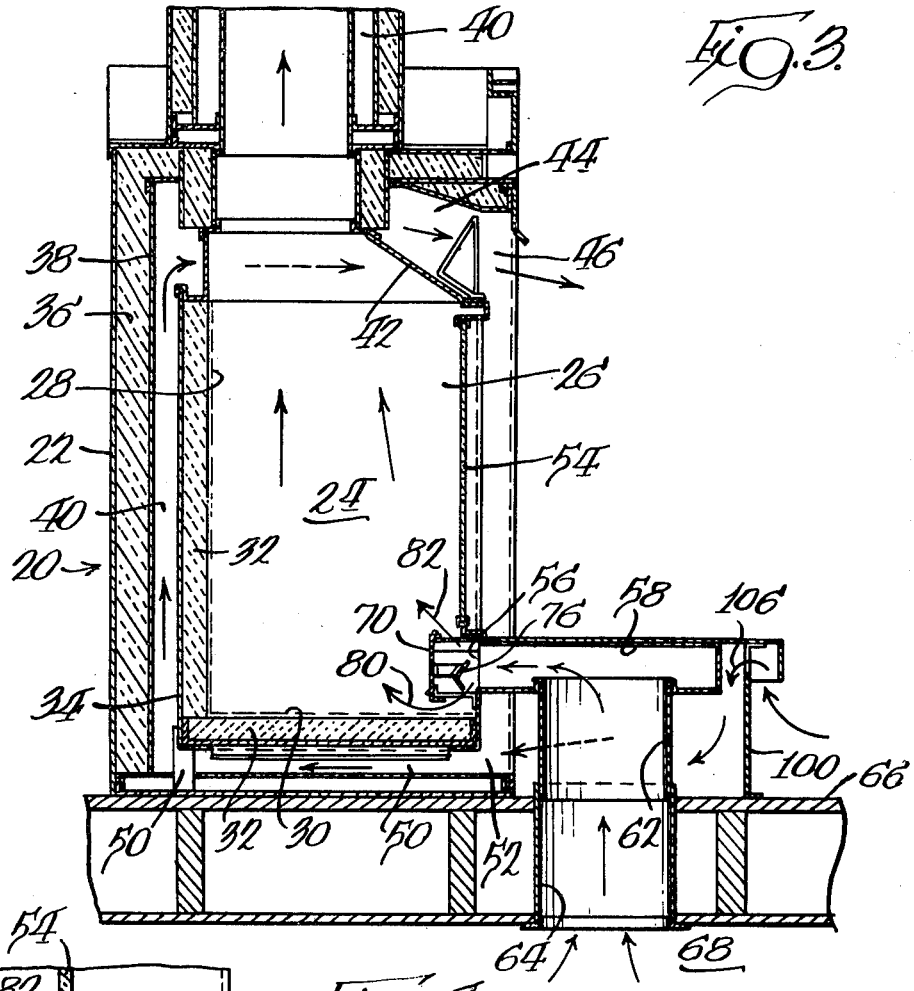
FIG. 3 is a vertical section taken approximately along the line 3—3 of FIG. 1.

An embodiment of a fireplace construction made according to the invention is illustrated in FIGS. 1–4, inclusive, and with specific reference to FIGS. 1 and 3, is seen to include a housing, generally designated 20, formed of sheet metal walls 22 or the like. Within the housing 20 is a firebox 24 having side walls 26, a rear wall 28 and a bottom wall 30. The walls 28 and 30 are backed by refractory block 32 for insulating purposes and the blocks 32 are, in turn, backed by sheet metal 34 for protective purposes.

Inwardly of the sheet metal wall 22 of the housing 20 is a mass of insulating material 36 which is backed by sheet metal 38 spaced from the backing 34 for the refractory 32. As a consequence, an air space 40 between the firebox 24 and the housing 20 is defined. Within the housing 20, and above the firebox 24, is a hood 42 defining an outlet from the firebox 24 for combustion gases and which is adapted to be in fluid communication with a flue 40 extending to the interior of the structure in which the fireplace is located. The hood 42 is configured to narrow progressively from its lower extent to its upper, so that a continuation 44 of the air space 40 is provided and such that an outlet 46 from the air space 40 is defined by the forwardmost edge of the hood 42, the forwardmost upper edge of the housing 20 and the upper extremities of the side walls of the housing 20.

As best seen in FIG. 3, the firebox 24 is provided with feet 50 raising the same above the lower extremity of the housing 20 to provide a further continuation 50 of the air space 40. The lower, forwardmost edge of the firebox 24 in connection with the lower, forwardmost edge of the housing 20 and the side walls thereof define an inlet 52 to the air space.

The remaining, open side of the firebox 24 is adapted to be substantially sealed by means of two transparent doors 54 suitably hinged for movement about vertical axes between open and closed positions.

Figure 4:
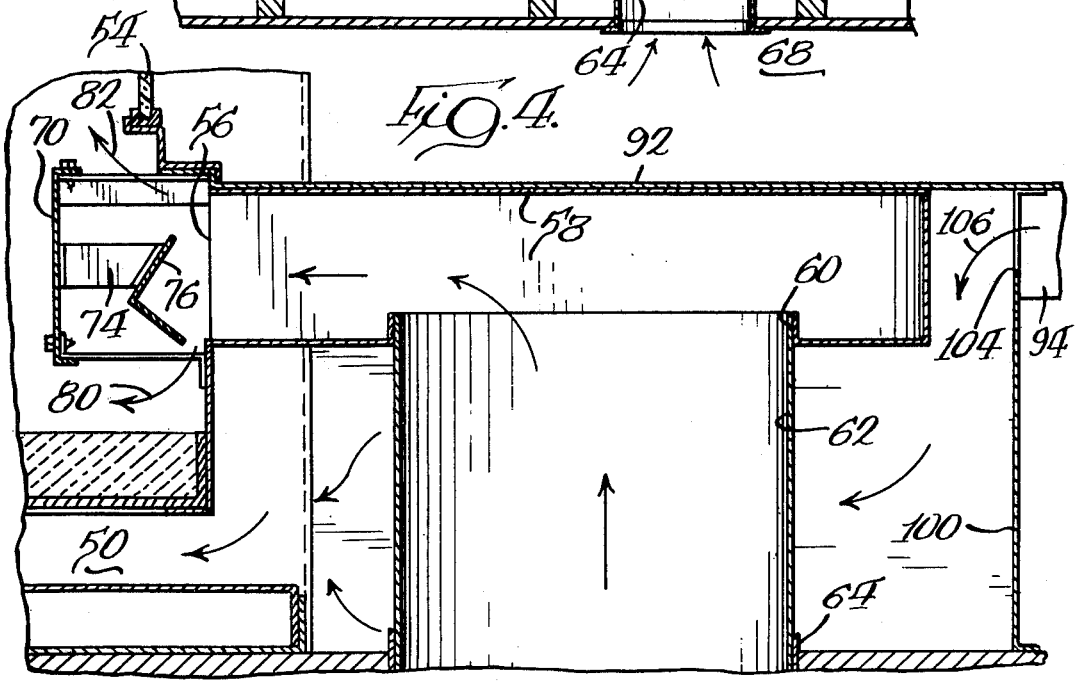
FIG. 4 is a fragmentary, vertical section of the hearth structure and a portion of the fireplace construction.

Just below the doors 54, as best seen in FIGS. 3 and 4, an opening 56 to the firebox 24 near its lower extremity is provided by the open end of a pyramid-shaped duct 58. The duct 58 includes a downwardly-facing opening 60 for receipt of a cylindrical duct 62, the lower end of which may be received in a duct 64 extending through the floor 66 of the structure housing the fireplace into a suitably ventilated crawl space 68 therebelow. As a consequence, the ducts 58, 62 and 64 define an air flow path from the exterior of the structure to the interior of the firebox 24 near the lower extremity of the latter for the admission of combustion air from a location exterior of the structure.

A vertically oriented, horizontal elongated, deflector 70 is mounted on spaced brackets 72 secured to the pyramid-shaped duct 58 in spaced relation to the open base thereof for the purpose of preventing sparks, cinders, or the like from entering into the duct 58. Brackets 74 mounted on the deflector 70, in turn, mount a V-shaped baffle 76 in proximity to the opening 56 so that outside air passing through the aforementioned flow path will impinge upon the baffle 76 to deflect downwardly in the direction of an arrow 80 as illustrated in FIGS. 3 and 4, as well as upwardly in the direction of an arrow 82. The upward air flow will tend to pass along the interior surface of the doors 54 to preclude or minimize the depositing thereon of products of combustion. In other words, the upwardly moving current of air in adjacency to the sides of the doors exposed to the fire tends to keep the doors from clouding due to tars or the like resulting from combustion.

A hearth structure, generally designated 90, is provided to house the ducts 58 and 62. The same includes a horizontally disposed member 92 having downturned sides 94 which may be mounted on horizontally directed flanges 96 on the upper edge of a three-walled support 100. The support 100 is adapted to be disposed on the floor 66 of the structure and is provided with horizontally directed flanges 102 at its lower extremity for that purpose.

The relative dimensioning of the downturned sides 94 and the corresponding walls of the support 100 is such that there is substantial spacing therebetween with the support 100 being located inwardly of the downturned sides 94. The upper edges of the walls of the support 100 include cutouts 104 which are masked from view by the downturned sides 94 and which allow air within the structure housing the fireplace to enter the support 100 as illustrated by arrows 106 in FIGS. 3 and 4. From the interior of the support 100, such air has free access to the inlet 52. Thus, air from the interior of the structure housing the fireplace may enter the air space 40 and, by reason of being heated in the air space 40 when a fire is in progress in the fireplace 42, pass therethrough to the outlet 46 to reenter the structure. Such convection currents perform the dual function of cooling the firebox 24 and providing a source of heat to the structure.

It is also to be noted that the air flow path for interior air is completely isolated from that for exterior air. Consequently, by reason of the sealing of the open side of the fireplace by the doors 54, there is virtually no possibility that products of combustion can enter the structure housing the fireplace. Similarly, air from within the interior of the structure cannot be consumed as combustion air, resulting in the possibility of oxygen starvation.

It will be appreciated that in a fireplace made according to the invention, totally isolated flow paths are established for combustion gases generated by fire combustion with outside air and convection circulated inside air. By reason of the use of the doors 54 substantially sealing the firebox, combustion air must be drawn from the exterior of the structure to preclude the possibility of oxygen starvation to the occupants of the structure. This feature is particularly desirable in relatively airtight structures, such as mobile homes or the like. The use of the baffles precludes substantial clouding of the transparent doors 54 and also precludes hot sparks, or cinders, or the like from being thrown by the fire into the air flow paths to create a fire hazard.

It will also be appreciated that the isolation of the flow path for outside combustion air precludes the existence of a path of entry into the interior of the structure in which the fireplace is housed for insects or the like.

It will be recognized that the unique hearth structure may be readily disassembled for cleaning purposes or the like. That is, by simply removing the member 92, simple access to the duct work including the duct 58 and the baffles in the interior thereof may be achieved.

We claim:

1. In a fireplace construction, the combination of:

a firebox having an open side and a combustion gas outlet adapted to be in fluid communication with a flue;

a transparent door for substantially sealing said open side;

a housing at least partially surrounding said firebox in close proximity thereto;

a circulating air inlet in said housing below said open side through which air in a structure housing the fireplace may enter said housing;

a circulating air outlet in said housing above said open side through which air in said housing may exit the housing to re-enter the structure housing the fireplace, said housing, said circulating air inlet and outlet defining a circulating air flow path about said firebox;

means forming a combustion air inlet in said firebox below said door through which combustion air may enter said firebox;

a hearth structure positioned forwardly of the housing below said door overlying said circulating air inlet and said combustion air inlet, said hearth including a three-walled vertical support adapted to be disposed on the floor of the structure housing the fireplace having an open side abutting the fireplace and a horizontal member seated on the upper end of said support having downturned sides spaced outwardly from said support, said support having cutouts at the upper end thereof masked by said downturned sides to permit air within the structure housing the fireplace to enter said hearth and have free access to said circulating air inlet; and an inlet conduit for combustion air having one conduit section connected to said combustion air inlet and an entry section extending downwardly through said hearth structure with its outer end positioned exteriorly of the structure housing the fireplace.

2. In a fireplace construction, the combination of:

a firebox having an open forward side and a combustion gas outlet adapted to be in fluid communication with a flue;

a door for substantially sealing said open side;

a housing at least partially surrounding said firebox in close proximity thereto;

a circulating air inlet in the forward side of said housing below said open side and door through which air in a structure housing the fireplace may enter said housing;

a circulating air outlet in said housing above said open side through which air in said housing may exit the housing to re-enter the structure housing the fireplace, said housing, said circulating air inlet and outlet defining a circulating air flow path about said firebox;

means forming a combustion air inlet in the forward side of said firebox below said open side and door through which combustion air may enter said firebox;

a hollow hearth structure positioned forwardly of the housing, said hearth structure including a support member adapted to be disposed on the floor of the structure housing the fireplace and a cover member on said support member extending forwardly from a point against said housing below said door and above said circulating air inlet and said combustion air inlet, passage means defined in said hearth structure through which air from the structure housing the fireplace is drawn into the interior of said hearth structure and may have free access to said circulating air inlet; and an inlet conduit for combustion air having one end connected to said combustion air inlet and extending through the interior of said hearth structure with its other end positioned exteriorly of the structure housing the fireplace so that combustion air is isolated from circulating air within said hearth structure.

* * * * *